US008292986B2

(12) United States Patent
Goia et al.

(10) Patent No.: US 8,292,986 B2
(45) **Date of Patent: *Oct. 23, 2012**

(54) PREPARATION OF SILVER SPHERES BY THE REDUCTION OF SILVER POLYAMINE COMPLEXES

(75) Inventors: Daniel V. Goia, Postsdam, NY (US); Ionel Halaciuga, Postsdam, NY (US)

(73) Assignee: E I du Pont de Nemours and Company, Wilmington, DE (US)

( * ) Notice: Subject to any disclaimer, the term of this patent is extended or adjusted under 35 U.S.C. 154(b) by 613 days.

This patent is subject to a terminal disclaimer.

(21) Appl. No.: 12/234,341

(22) Filed: Sep. 19, 2008

(65) Prior Publication Data

US 2009/0071292 A1 Mar. 19, 2009

Related U.S. Application Data

(60) Provisional application No. 60/960,170, filed on Sep. 19, 2007.

(51) Int. Cl.
*B22F 9/24* (2006.01)

(52) U.S. Cl. ..... 75/362; 75/371

(58) Field of Classification Search ..... 75/371
See application file for complete search history.

(56) References Cited

U.S. PATENT DOCUMENTS

| | | | | |
|---|---|---|---|---|
| 5,292,359 | A | 3/1994 | Jeng-Shyong et al. | |
| 5,389,122 | A | 2/1995 | Glicksman | |
| 7,291,292 | B2 | 11/2007 | Ittel | |
| 7,922,940 | B2 * | 4/2011 | Ittel | 252/514 |
| 2006/0235087 | A1 * | 10/2006 | Alexandridis et al. | 516/78 |
| 2007/0034052 | A1 * | 2/2007 | Vanheusden et al. | 75/362 |
| 2007/0045589 | A1 | 3/2007 | Ittel | |
| 2007/0290175 | A1 * | 12/2007 | Kim | 252/500 |
| 2008/0028889 | A1 | 2/2008 | Irizarry-Rivera | |

FOREIGN PATENT DOCUMENTS

WO 2006/066033 A 6/2006

OTHER PUBLICATIONS

Lorenza Suber et al., Preparation and the Mechanisms of Formation of Silver Particles of Different Morphologies in Homogeneous Solutions, J. of Colloid and Interface Science, 2005, vol. 288:489-495.
Matijevic, "Formation Mechanisms of Uniform Colloid Particles", Croatica Chemica Acta, Nov. 2007, pp. 485-491.
Halaciuga et al., "Preparation of Silver Spheres by Aggregation of Nanosize Subunits", Journal of Materials Research, Jun. 2008, pp. 1776-1784, vol. 23, No. 6.
International Search Report for International Application No. PCT/US2008/077061 Dated Aug. 11, 2009.

* cited by examiner

*Primary Examiner* — George Wyszomierski

(57) ABSTRACT

Dispersed uniform spherical silver particles were prepared in the absence of a protective colloid by rapidly mixing concentrated iso-ascorbic acid and silver-polyamine complex solutions.

15 Claims, 4 Drawing Sheets

Electron micrographs of silver particles obtained by reducing at 60°C complexes of $Ag^{+}$ with a) ethylene diamine (EDA), b) diethylene triamine (DETA), c) triethylene tetraamine (TETA), and d) tetraethylene pentaamine (TEPA) at a ligand:Ag molar ratio of 4:1

Figure 1. Electron micrographs of silver particles obtained by reducing at 60°C complexes of $Ag^+$ with a) ethylene diamine (EDA), b) diethylene triamine (DETA), c) triethylene tetraamine (TETA), and d) tetraethylene pentaamine (TEPA) at a ligand:Ag molar ratio of 4:1
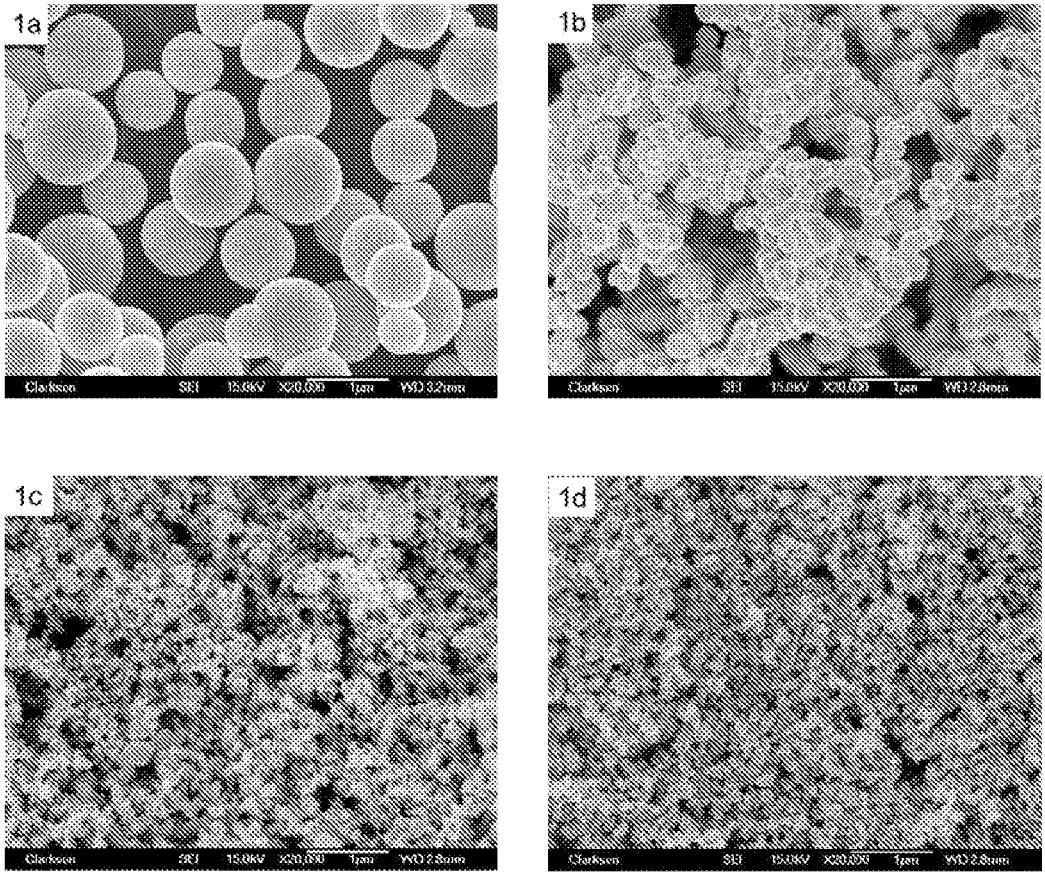

Figure 2. Silver particles obtained with EDA at a) 20, b) 40, c) 60, and d) 80 °C
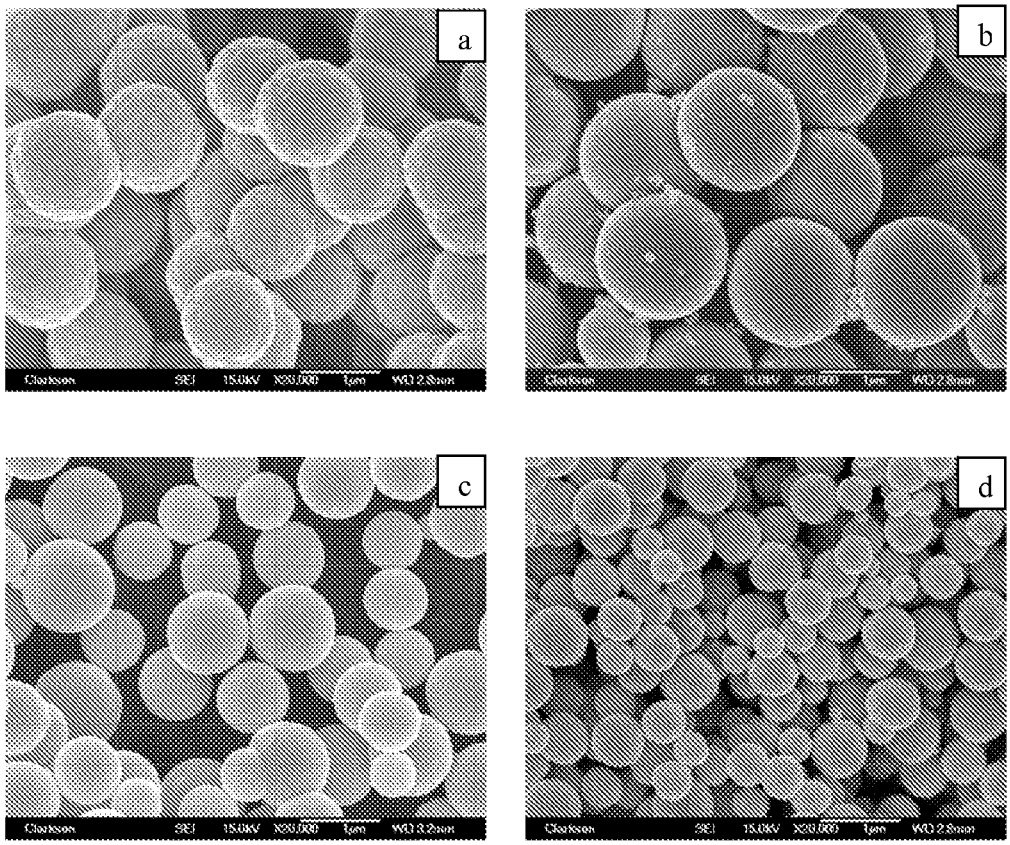

Figure 3. Field emission electron micrographs of silver particles obtained at Ag/EDA molar ratio of a) 1:1, b) 1:2, and c) 1:4.
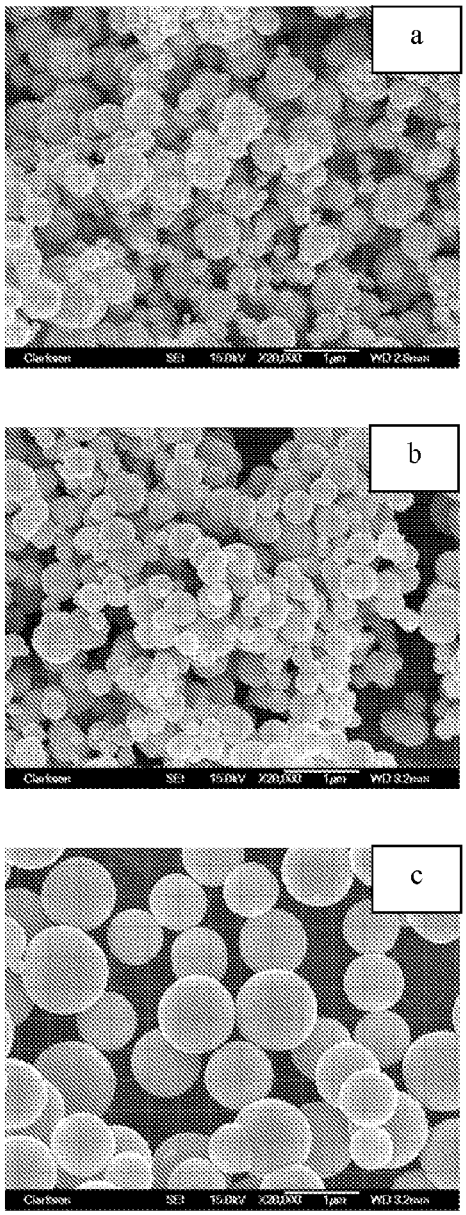

Figure 4. Silver spheres obtained in a) 100% water (Sample #1), b) 95% water/5% DEG, c) 75%water/25%/DEG, and d) 100% DEG.
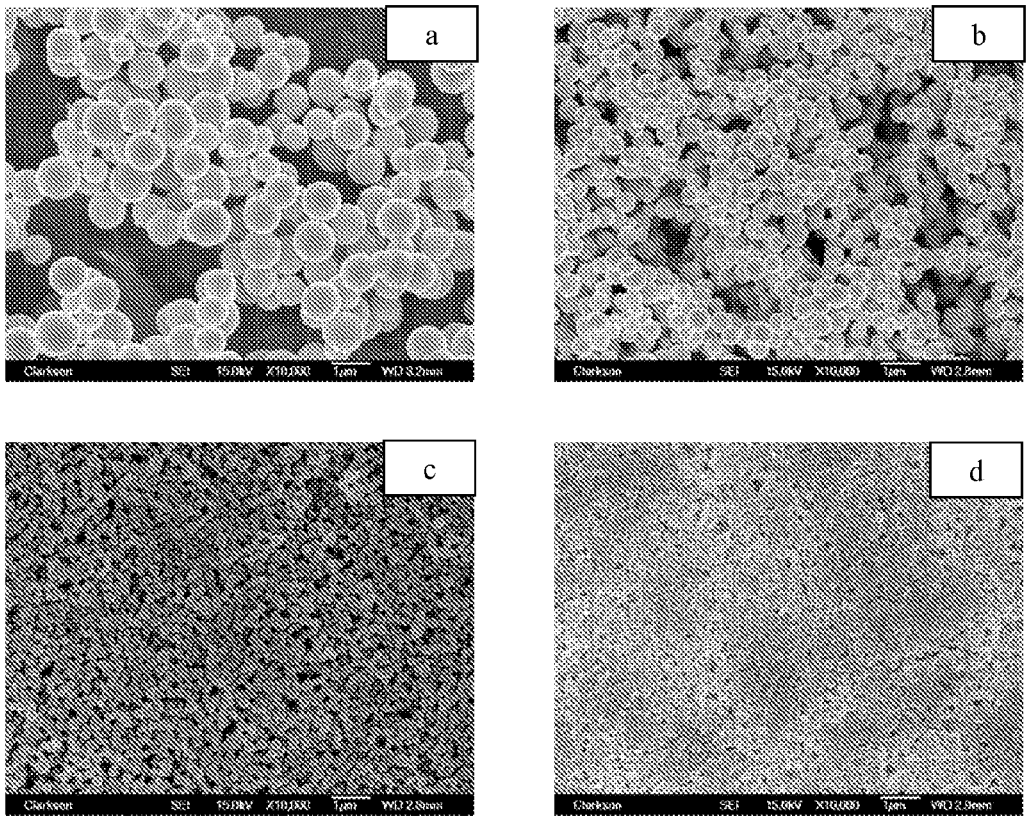

PREPARATION OF SILVER SPHERES BY THE REDUCTION OF SILVER POLYAMINE COMPLEXES

This application claims benefit of U.S. application 60/960,170 filed Sep. 19, 2007.

FIELD OF THE INVENTION

This application relates to preparation of spherical silver particles from silver salts.

TECHNICAL BACKGROUND

Silver particles with various shapes are used to build conductive elements in plasma display panels, multi layer ceramic capacitors, solar cells, printed circuit boards and many other thick film components incorporated in most electronics surrounding us. The technological progress in these applications depends increasingly on the ability to control the size, shape, and internal structure of the particles. Highly dispersed uniform spherical silver particles are particularly important for the electronic industry, as they provide very distinct advantages. In the manufacturing of plasma display panels silver spheres with a smooth surface allow a better photolithographic patterning. The superior packing of such particles favors the formation of compact 'green' structures that yield continuous conductive sintered layers. Most silver powders presently used in electronics are generated by processes using high molecular weight polymers as dispersants and contain residual organics which can interfere with their sintering.

Fine silver particles have been prepared by various methods including the reduction of silver salts in solutions or reverse micelles systems, photoreduction, and thermolysis. The precipitation in homogeneous solutions is by far the most versatile approach due to the broad range of solvents available and the large variety of reductants, dispersants, and complexing agents. Although there are a few methods capable of generating large silver spheres in the absence of dispersants but they use low metal concentration and undesirable chemicals. Therefore, the present inventors desired to create an improved method of formation of well dispersed, uniform large spherical silver particles, without polymers as protective colloids.

U.S. 2008/0028889 Irizarry-Rivera et al—Process for Making Highly Dispersible Spherical Silver Powder Particles and Silver Particles Formed There from—Reduce silver nitrate with ascorbic acid in the presence of additives.

J. of Colloid and Interface Science 288 (2005) 489-495 Preparation and the mechanisms of formation for silver particles of different morphologies in homogeneous solutions—Reduce silver nitrate with ascorbic acid in the presence of a sodium naphthalene sulfonate-formaldehyde copolymer.

U.S. Pat. No. 7,291,292 Ittel—Preparation of Silver Particles Using Thermomorphic Polymers—Making colloidal silver particles through the reduction of a silver salt in the presence of an amine base and a thermomorphic polymer that allows for the isolation of the colloidal silver and washing.

U.S. Pat. No. 5,389,122 Glicksman—Process for Making Finely Divided, Dense Packing, Spherical Shaped Silver Particles—Reduce silver ethanolamine complex with ascorbic acid.

SUMMARY OF THE INVENTION

Described is a method for the formation of dispersed, uniform, smooth surface, spherical silver particles without the use of a protective colloid comprising the sequential steps of:

a. dissolving a silver salt in a solvent and mixing this solution with a polyamine to form a solution of a silver-polyethylene amine complex;
b. preparing a reducing solution comprising iso-ascorbic acid or ascorbic acid dissolved in a solvent;
c. adding the reducing solution to the silver-polyethylene amine complex solution to form finely divided, dispersed, uniform shaped spherical silver particles;
d. separating the silver particles from the solution of step (c);
e. washing the silver particles with a solvent; and
f. drying the finely divided, dispersed, uniform shaped spherical silver particles.

BRIEF DESCRIPTION OF DRAWINGS

FIGS. 1*a*-1*d* are electron micrographs of silver particles obtained by reducing complexes of silver at 60 degrees C.

FIGS. 2*a*-2*d* are micrographs of silver particles obtained with EDA (ethylene diamine) at 20, 40, 60 and 80 degrees C.

FIGS. 3*a*-3*c* are electron micrographs of silver particles obtained at Ag/EDA molar ratios 1:1, 1:2, and 1:4.

FIGS. 4*a*-4*d* are silver spheres obtained in water and DEG.

DETAILED DESCRIPTION OF THE INVENTION

This invention involves the process where complexes formed between silver and linear polyamines are reduced with iso-ascorbic acid to yield large, well dispersed uniform silver spheres in the absence of protective colloids. With the absence of protective colloids, the resulting silver powders contain only organics which decompose at temperatures low enough not to interfere with the sintering process and the formation of highly conductive silver structures. The silver spheres are formed by rapid aggregation of nanosize silver entities and their final size can be controlled by changing the dynamics of the aggregation process.

Silver-polyamine complex solutions can be made in solvents such as water or other suitable solvents that can dissolve the silver salt and the reducing agent and are compatible with the polyamine. Solvents that can be used that are different from water are polyols such as diethyleneglycol (DEG). In some embodiments the solvent is water.

The silver polyamine complex aqueous solution is prepared by first adding a water-soluble silver salt to deionized water. Any water-soluble silver salt such as silver nitrate, silver phosphate, silver sulfate and the like can be used in the process of the invention. In some embodiments the silver salt is silver nitrate. The polyamine is added next to form the silver-polyamine complex solution. The polyamine can be a linear or a substituted linear polyamine such as ethylenediamine, diethylenetriamine, triethylenetetramine, and tetraethylenepentamine. The silver-polyamine complex solution is brought to the desired temperature prior to the precipitation. Desired temperature may vary greatly depending upon solvent, concentration, and choice of reactants. In some embodiments the temperature is about 20° C. or less, and in other embodiments is 80° C. or more.

The reducing solution is prepared by dissolving the reducing agent in deionized water. Suitable reducing agents for the process for the invention are L-ascorbic acid and D-ascorbic acid and their salts.

The reducing solution is rapidly added to the silver-polyamine complex solution to form the finely divided, dense packing, spherical silver particles. After the precipitation is complete, the silver particles are separated from the water, washed, and dried.

Silver powders with different particle size distributions can be made by varying the molecular weight of the polyamine. The range of particles sizes can vary from less than 0.1 microns up to grater than 1 micron (as measured by scanning electron microscopy). The size decreased and the uniformity of the particle morphology degraded as the molecular weight of the polyamine increased. Smaller particles can be made by going from ethylene diamine to diethylene triamine, to triethylene tetramine, and tetraethylene pentamine. The temperature can also be used to vary the particle size distribution. Varying the temperature between 20° C. and 80° C. gives a range of particle sizes from less than 0.3 microns to greater than 2.5 microns (as measured by scanning electron microscopy).

Changing the molar ratio of silver to polyamine changes the resulting particle size of the silver particles. The molar ratio of silver to polyamine can vary from 1:1 to more than 4:1. Increasing the molar excess of the polyamine improved the uniformity of the silver particles and the average size increased.

The process can be done in solvents other than water. Changing the solvent does change the particle size of the silver powder. Using diethylene glycol as the solvent gave very small particles with a size of about 0.1 micron (as measured by scanning electron microscopy). Blends of diethylene glycol and water can be used to provide a range of particles sizes of silver powder from 0.1 microns to 1 micron (as measured by scanning electron microscopy).

EXAMPLES

The following examples and discussion are offered to further illustrate, but not limit the process of the invention. The following process description is what was used to make the examples shown in Table 1.

Aqueous solutions of silver-polyamine complexes were prepared in a 1000 $cm^3$ cylindrical glass beaker by first dissolving 0.05 moles of silver salt in 250 $cm^3$ deionized water, then adding the specified amount of polyamine, and finally adjusting the volume to 440 $cm^3$ with water. Polyamines that were used included ethylenediamine (EDA), diethylenetriamine (DETA), triethylenetetraamine (TETA), and tetraethylenepentamine (TEPA). The solutions were then heated at 80° C. for 2 hours before being cooled to the reaction temperature. The reductant solution was prepared in a separate 100 $cm^3$ glass beaker by dissolving 0.03 moles of iso-ascorbic acid crystals (representing a 20% stoichiometric excess) in cold deionized water and bringing the volume to 60 $cm^3$. For ease of comparison in each example the concentration of the silver amine solution was 0.1 moles per $dm^3$ and the concentration of the iso-ascorbic acid solution was 0.44 moles per $dm^3$, although in ordinary practice the concentration may vary.

The silver particles were formed by adding rapidly the cold iso-ascorbic acid solution into the vigorously mixed Ag-polyamine complex solution. The final volume in all cases was 500 $cm^3$ and the metal concentration 0.1 mol $dm^{-3}$. After the silver was completely reduced, which took less than 2 min, the dispersion was stirred for 20 more minutes before the solids were allowed to settle. The clear supernatant was subsequently decanted and the silver particles were washed three times with 500 $cm^3$ deionized water and three times with 100 $cm^3$ of ethanol. Finally, the particles were separated by filtration and dried at 70° C. in vacuum for several hours. Further details of the process used for each example is in Table 1.

As shown in examples 1-4, the size of the particles got smaller and their uniformity degraded as the polyamine molecular weight increased. Ethylene diamine produced particles with an approximate average size of 0.97 whereas diethylene triamine gave a size of 0.29 microns and triethylene tetramine gave a size of 0.06 microns. This affect is shown in FIG. 1.

Example 1A shows that heat treating the silver powder decreases the organic content and increases the crystallinity without changing the particle size.

Comparing example 1 with examples 5-7 demonstrates that changing the reaction temperature can affect the particles size, sphericity, and surface smoothness. Refer to FIG. 2. As the temperature of the reaction is increased, the particle size decreased, as detected by a field emission scanning electron microscope. The best sphericity and surface smoothness was obtained at a reaction temperature of 60° C.

Examples 7-9 demonstrate the effect of changing the silver to polyamine ratio. Increasing the molar excess of the polyamine from a silver to polyamine ratio of 1:1 to 4:1 significantly improved the uniformity and increased the average size. This effect is shown in FIG. 3.

Example 10 showed that silver powder can be made using silver salicilate as a replacement for the silver nitrate starting material.

Examples 11-13 demonstrate the effect of changing the solvent from water to diethylene glycol (DEG). Increasing the ratio of DEG to water produced smaller particles. This effect is also shown in FIG. 4.

TABLE 1

| Example # | Silver precursor | Amine[a] | Amine:Silver molar ratio | Solvent[b] | Temperature (° C.) | Organic content (%)[c] | Crystallite size (nm)[d] | Average diameter (μm)[e] |
|---|---|---|---|---|---|---|---|---|
| 1 | $AgNO_3$ | EDA | 4:1 | water | 60 | 2.2 | 14 | 0.97 |
| 1A[f] | na | na | na | na | 220 | 0.18 | 57 | 0.97 |
| 2 | $AgNO_3$ | DETA | 4:1 | water | 60 | 1.25 | 18 | 0.29 |
| 3 | $AgNO_3$ | TETA | 4:1 | water | 60 | 1.19 | 20 | 0.06 |
| 4 | $AgNO_3$ | TEPA | 4:1 | water | 60 | 0.9 | 18 | 0.08 |
| 5 | $AgNO_3$ | EDA | 4:1 | water | 20 | 2.3 | 13 | 1.36 |
| 6 | $AgNO_3$ | EDA | 4:1 | water | 40 | 0.86 | 15 | 2.48 |
| 7 | $AgNO_3$ | EDA | 4:1 | water | 80 | 3.2 | 22 | 0.33 |
| 8 | $AgNO_3$ | EDA | 1:1 | water | 60 | 2.3 | 19 | 0.40 |
| 9 | $AgNO_3$ | EDA | 2:1 | water | 60 | 2.38 | 18 | 0.38 |
| 10 | $AgC_7H_5O_3$ | EDA | 4:1 | water | 60 | 2.39 | 22 | 0.62 |
| 11 | $AgNO_3$ | EDA | 4:1 | 100% DEG | 60 | 1.33 | 14 | 0.096 |

TABLE 1-continued

| Example # | Silver precursor | Amine[a] | Amine:Silver molar ratio | Solvent[b] | Temperature (° C.) | Organic content (%)[c] | Crystallite size (nm)[d] | Average diameter (μm)[e] |
|---|---|---|---|---|---|---|---|---|
| 12 | $AgNO_3$ | EDA | 4:1 | 25% DEG | 60 | 2.07 | 15 | About 0.2 |
| 13 | $AgNO_3$ | EDA | 4:1 | 5% DEG | 60 | 2.39 | 18 | About 0.5 |

[a]EDA ethylene diamine; DETA diethylenetriamine; TETA triethylenetetraamine; TEPA tetraethylenepentamine
[b]DEG diethylene glycol
[c]the content of the organic matter in silver particles was assessed by thermogravimetric analysis (TGA) using a Perkin Elmer Pyris 1 instrument
[d]the crystallite size was determined by X-Ray diffraction (XRD) using a Bruker D8 diffractometer and the Cu $K_\alpha$ wavelength (1.5406 Å)
[e]by field emission scanning electron microscope (FESEM) with a Joel 7400 instrument where 100 particles were measured from electron micrographs
[f]powder from example 1 was heat treated at 220° C. for 9 hours

What is claimed is:

1. A method for the formation of dispersed, uniform, smooth surface, spherical silver particles without the use of a protective colloid comprising the sequential steps of :

(a) dissolving a silver salt in a solvent and mixing this solution with a polyamine to form a solution of a silver-polyethylene amine complex;

(b) preparing a reducing solution comprising iso-ascorbic acid or ascorbic acid dissolved in a solvent;

(c) adding the reducing solution to the silver-polyethylene amine complex solution to form finely divided, dispersed, uniform shaped spherical silver particles;

(d) separating the silver particles from the solution of step (c);

(e) washing the silver particles with a solvent; and (f) drying the finely divided, dispersed, uniform shaped spherical silver particles.

2. The method of claim 1 wherein said silver salt is silver nitrate.

3. The method of claim 1 wherein step (c) is performed in the temperature range 20° C. to 80° C.

4. The method of claim 1 wherein the polyethylene amine is a linear poly-amine or a substituted linear poly-amine.

5. The method of claim 1 wherein the polyethylene amine is selected from the group consisting of: ethylenediamine, diethylenetriamine, triethylenetetraamine, and tetraethylenepentamine.

6. The method of claim 5 where the polyamine is ethylenediamine.

7. The method of claim 1 where the reducing solution includes one of the following: L-ascorbic acid, D-ascorbic acid, and their salts.

8. The method of claim 1 where the reducing solution comprises isoascorbic acid.

9. The method of claim 1 where the particles are dried at 220° C. to remove residual organic material and increase the crystallinity.

10. The method of claim 1 where the ratio of Ag/polyethylene amine is equal to or greater than 1:1.

11. The method of claim 10 where the ratio of Ag/polyethylene amine is equal to or greater than 4:1.

12. The method of claim 1 where the solvent of step (a) is water.

13. The method of claim 1 where the solvent of step (a) is a polyol.

14. The method of claim 13 where the solvent is diethylene glycol.

15. The method of claim 1 where the solvent of step (a) is a mixture of a polyol and water.

* * * * *